United States Patent [19]

Manaka et al.

[11] Patent Number: 4,862,855

[45] Date of Patent: Sep. 5, 1989

[54] CONTROL APPARATUS FOR INTERNAL COMBUSTION ENGINE

[75] Inventors: Toshio Manaka; Akira Teragakiuchi; Masahide Sakamoto; Masami Nagano; Masakatsu Fujishita, all of Katsuta; Junji Miyake, Mito, all of Japan

[73] Assignee: Hitachi, Ltd., Tokyo, Japan

[21] Appl. No.: 163,301

[22] Filed: Mar. 2, 1988

[30] Foreign Application Priority Data

Mar. 11, 1987 [JP] Japan ..... 62-54145

[51] Int. Cl.[4] ..... F02M 39/00

[52] U.S. Cl. ..... 123/489; 123/440

[58] Field of Search ..... 123/489, 440

[56] References Cited

U.S. PATENT DOCUMENTS

| | | | |
|---|---|---|---|
| 4,348,727 | 9/1982 | Kobayashi | 123/440 |
| 4,466,410 | 8/1984 | Sakakibara | 123/489 |
| 4,517,948 | 5/1985 | Kaji | 123/489 |
| 4,561,400 | 12/1985 | Hattori | 123/440 |

FOREIGN PATENT DOCUMENTS

| | | | |
|---|---|---|---|
| 0152001 | 8/1985 | European Pat. Off. | 123/489 |

*Primary Examiner*—Carl Stuart Miller

*Attorney, Agent, or Firm*—Antonelli, Terry & Wands

[57] ABSTRACT

Values of a correction amount of correcting a fundamental control amount of an internal combustion engine are stored in a rewritable memory having divisional storage areas corresponding to divisional running areas. When a value of the correction amount for a particular divisional running area is renewed, concurrently therewith, values of the correction amount for divisional running areas adjacent to the particular divisional running area are also renewed.

4 Claims, 7 Drawing Sheets

FIG. 1

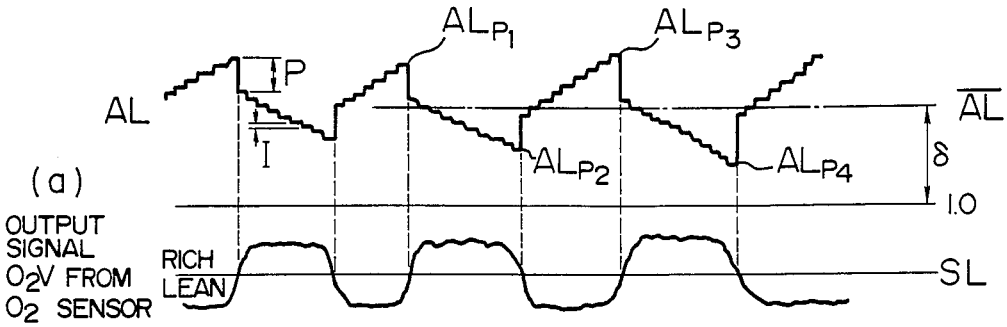

(b)

TABLE

| DIFFERENCE δ | $0 \sim \delta_0$ | $\delta_0 \sim \delta_1$ | $\delta_1 \sim \delta_2$ | $\delta_2 \sim \delta_3$ |
|---|---|---|---|---|
| LEARNING CORRECTION AMOUNT $X_n$ | $X_0$ | $X_1$ | $X_2$ | $X_3$ |

(c)

TABLE

| FIRST Qa DIVISION POINTS (1) FOR FIRST LEARNING AREA | 0 ~ 8 | 8 ~ 16 | 16 ~ 23 | 23 ~ 31 | 31 ~ 47 | 47 ~ 63 |
|---|---|---|---|---|---|---|
| FIRST LEARNING VALUE $L_{1n}$ | $L_{10}$ | $L_{11}$ | $L_{12}$ | $L_{13}$ | $L_{14}$ | $L_{15}$ |

(d)

TABLE

| SECOND Qa DIVISION POINTS(2) FOR SECOND LEARNING AREA | 0 ~ 12 | 12 ~ 20 | 20 ~ 27 | 27 ~ 39 | 39 ~ 55 | 55 ~ 71 |
|---|---|---|---|---|---|---|
| SECOND LEARNING VALUE $L_{2n}$ | $L_{20}$ | $L_{21}$ | $L_{22}$ | $L_{23}$ | $L_{24}$ | $L_{25}$ |

$L_{22}New = k_0 * (L_{21}New + L_{22}0ld)$ $L_{21}New = L_{21}0ld + X_n$ $L_{20}New = k_0 * (L_{21}New + L_{20}0ld)$

CONTROL APPARATUS FOR INTERNAL COMBUSTION ENGINE

BACKGROUND OF THE INVENTION

This invention relates to an electronic control apparatus for internal combustion engines such as automobile gasoline engines and more particularly to a control apparatus for internal combustion engine having a learning function in order to constantly control the engine under the direction of optimized control parameters.

In an internal combustion engine such as a gasoline engine (hereinafter simply referred to as an engine), it is required that, for example, the supply amount of fuel be kept at a predetermined proportion to intake air and that the ratio therebetween (termed an air/fuel ratio) be always maintained correctly.

Conventionally, the intake air amount is measured and in accordance with measurement results, the supply amount of fuel is controlled such that a predetermined air/fuel ratio can be obtained. This method, however, can not achieve sufficiently accurate controlling from the standpoint of exhaust gas regulation.

Under the circumstances, a so-called air/fuel ratio feedback control method has been employed in which an air/fuel ratio sensor is used to detect an exhaust gas state and feedback-control the supply amount of fuel.

Conveniently, in the air/fuel ratio feedback controlling, the range over which the engine rotation number changes and the range over which the intake air amount changes are respectively divided into, for example, 10 sections and these sections are combined together to define 100 running areas. Area correction coefficients for the respective running areas are initially determined such that the stoichiometric air/fuel ratio equalling 14.7 can be obtained in each of the running areas, and these area correction coefficients are then stored in a memory. During engine running, the coefficients are read out of the memory as necessary so as to be used for calculating the injection amount, thus permitting the individual running areas to take the stoichiometric air/fuel ratio. This expedient can therefore prevent a transient aggravation of exhaust gas due to a delayed response in the air/fuel ratio feedback.

Incidentally, control characteristics for the engine greatly differ from one engine to another, depending on irregularity of characteristics of the engine per se and irregularity of characteristics of various sensors and actuators used for controlling.

This means that if the area correction coefficients necessary for the area correction method are initially prepared in view of a standard engine and applied to all of the other engines, almost no fruitful results can be obtained. Therefore, different sets of area correction coefficients must be prepared independently for different engines and then must be stored in ROM's respectively dedicated to the different engines, thus giving rise to degraded productivity prone to high costs.

Further, since the characteristics of the engine per se change with time and the characteristics of the sensors and actuators also change with time, it is frequent that area correction coefficients which are set at the initial phase of manufacture become almost unmatched as time elapses.

As a countermeasure for the above problems, a learning control scheme has recently been highlighted in which a memory capable of being written or rewritten with data is used for storing area correction coefficients and running areas (learning areas) of the memory are sequentially written and supplemented or rewritten with area correction coefficients experiencing learning during engine running, whereby accurate area correction coefficients (learn correction coefficients) based on the latest results of running can constantly be prepared for air/fuel ratio controlling.

According to the learning control scheme, the area correction coefficient need not be prepared initially and besides when characteristics of, for example, the engine change, the area correction coefficients can be self-corrected correspondingly, thereby ensuring that constantly correct controlling can be expected and the aggravation of exhaust gas, inclusive of the transient aggravation, can be prevented.

A prior art apparatus based on the learning control scheme is known as disclosed in, for example, JP-A-60-90944. In the known apparatus, a difference between an air/fuel ratio correction coefficient produced from an air/fuel ratio sensor and a reference value is determined and a learning value of a learning correction term used for correcting the air/fuel ratio correction coefficient is renewed by adding the difference at a predetermined proportion or percentage.

When as in the prior art the learning value of the learning correction term used for correcting the air/fuel ratio correction coefficient is renewed adding the difference between air/fuel ratio correction coefficient and reference value at the predetermined proportion, the renewed learning value becomes overestimated for a value of the difference or underestimated for another value of the difference, indicating that proper learning can not be undertaken. Another problem encountered in the prior art is that after a particular learning area is renewed, renewal of learning areas adjacent to the particular learning area is not done for an interval of time in the event that a certain learning condition is imposed, with the result that controlling can not be shifted smoothly from one learning area to another.

SUMMARY OF THE INVENTION

An object of this invention is to provide an air/fuel-ratio-learning control apparatus capable of constantly achieving proper learning and of providing sufficiently smooth controlling when one running area changes to another.

According to the invention, to accomplish the above object, an amount whose values are weighted by predetermined amounts in accordance with values of the difference between air/fuel ratio correction coefficient and reference value is calculated and used to renew the learning value of the learning value correction term, and when a particular learning divisional area is to be renewed, concurrently therewith, learning divisional areas adjacent to the particular learning divisional area are also renewed.

Because of the renewal of the learning value effected using the amount whose values are weighted by predetermined amounts in accordance with values of the difference and because of the renewal of a particular learning divisional area effected concurrently with renewal of learning divisional areas adjacent to the particular divisional area, proper learning results can be obtained continuously to permit accurate renewal of the air/fuel ratio correction coefficient, more ultimately, of the injection pulse width.

BRIEF DESCRIPTION OF THE DRAWINGS

FIG. 1 illustrates at sections (a) through (d) a waveform diagram and tables useful in explaining the operation of an air/fuel-ratio-learning control apparatus according to an embodiment of the invention.

DESCRIPTION OF THE PREFERRED EMBODIMENTS

An air/fuel-ratio-learning control apparatus of the invention will now be described by way of example with reference to the accompanying drawings.

Figure 2:
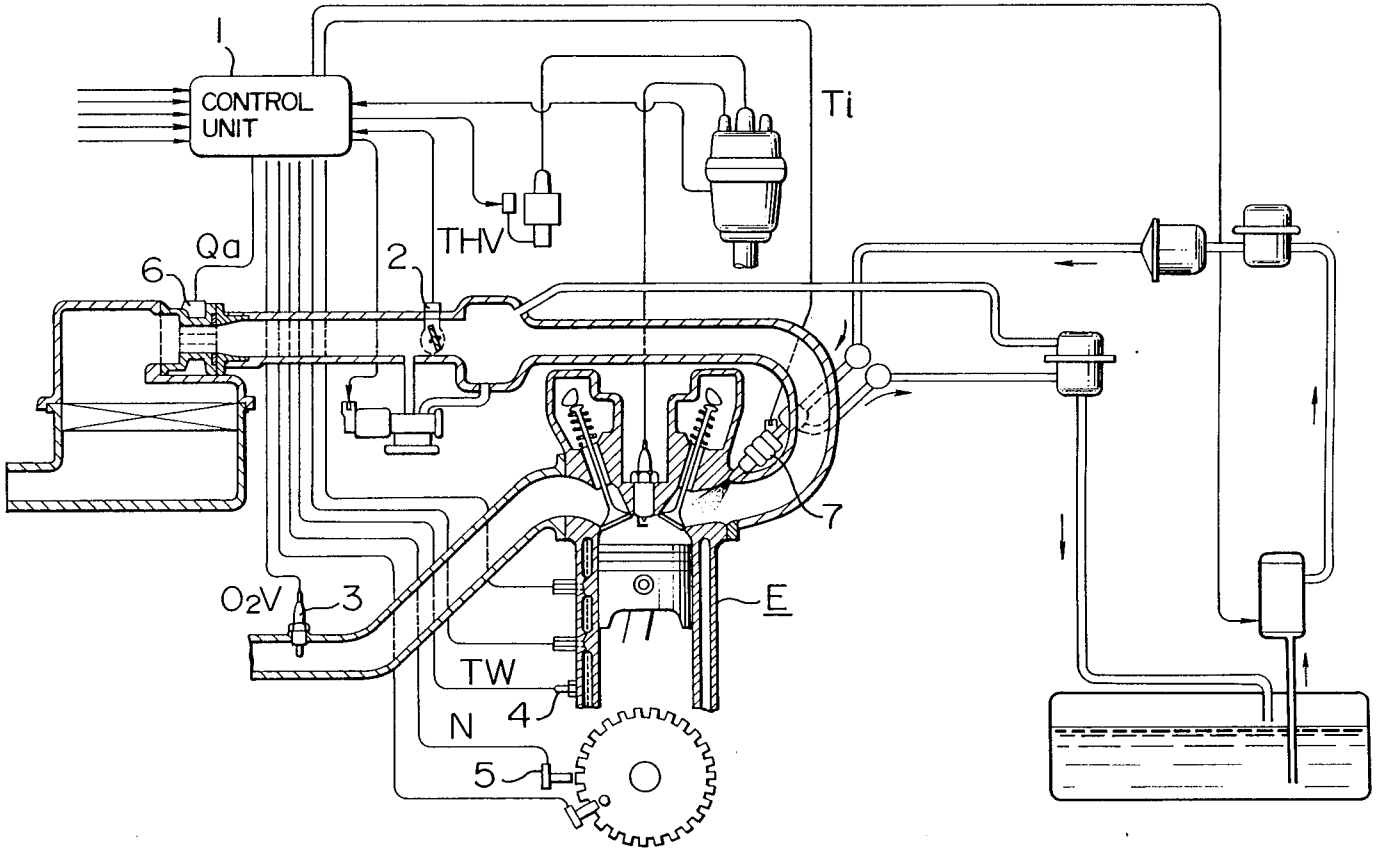
FIG. 2 is a schematic diagram showing an example of an engine system to which the embodiment of the invention is applied.

FIG. 2 shows an example of an engine system to which an embodiment of the invention is applied. In the illustrated engine system, a control unit 1 comprised of a microcomputer fetches data from various sensors mounted to an engine E, for example, a throttle valve opening THV from a throttle sensor 2, a sensor output signal $O_2V$ from an oxygen ($O_2$) sensor 3, a cooling water temperature TW from a water temperature sensor 4, an engine rotation number per unit time (engine speed) N from a rotation sensor 5, and an intake air amount Qa from an air flow sensor 6, and deals with the data so as to supply a fuel injection pulse width Ti to an injector 7, thereby carrying out air/fuel ratio controlling.

The embodiment of the invention operates as will be described below with reference to FIG. 1.

FIG. 1 diagrammatically shows that, at section (a), the lean/rich decision on the air/fuel ratio is effected using the output voltage $O_2V$ of the $O_2$ sensor 3 and an air/fuel ratio correction coefficient AL is increased or decreased by proportional portion P and integration portion I in accordance with results of the decision, and that, at sections (b), (c) and (d), a learning control operation of the embodiment of the invention is performed as illustrated in tables.

More particularly, an output signal $O_2V$ of the $O_2$ sensor 3 is first compared with a decision level SL and when the output voltage of the $O_2$ sensor exceeds the decision level SL, the air/fuel ratio is decided to be rich and the air/fuel ratio correction coefficient AL is subtracted with the proportional portion P and integration portion I. When the output voltage of the $O_2$ sensor is below the decision level SL, the air/fuel ratio is decided to be lean and the air/fuel ratio correction coefficient AL is added with the proportional portion P and integration portion I.

On the other hand, the injection pulse width Ti applied to the injector 7 is defined by the following equation and it is increased or decreased as the air/ fuel ratio correction coefficient AL increases or decreases:

$$Ti = COEF \times T_p \times \alpha + T_B$$

where $COEF = 1 + KW + KACC + KD + KFUL$, $T_p = k_3 \times Qa/N$, and $\alpha = AL + (k_1 \times L_{1n}) + (k_2 \times L_{2n})$ and where $T_B$ represents a battery voltage correction term, KW an enhancing correction term due to water temperature, KACC an enhancing correction term due to acceleration, KD an enhancing correction term after idling, KFUL an enhancing correction term due to full open of the throttle valve, $T_p$ a fundamental injection amount, $k_1$, $k_2$ and $k_3$ weighting coefficients, $L_{1n}$ a first learning value, $L_{2n}$ a second learning value, and $\alpha$ an ultimate air/fuel ratio correction coefficient wherein a term $(k_1 \times L_{1n}) + (k_2 \times L_{2n})$ is representative of a learning correction term for the air/fuel ratio correction coefficient.

When the steady running is decided, peak values $AL_{p1}$, $AL_{p2}$, $AL_{p3}$, $AL_{p4}$—of the air/fuel ratio correction coefficient AL are sampled and averaged to provide a mean value $\overline{AL}$ which is used to calculate a difference $\delta$ pursuant to $\delta = \overline{AL} - 1.0$ where 1.0 is a reference value.

Subsequently, by looking up the table shown at section (b) in FIG. 1, a learning correction amount Xn corresponding to a difference $\delta$ is retrieved, values of the learning correction amount Xn being weighted by predetermined amounts in accordance with values of difference $\delta$ and used to renew learning values.

Incidentally, in the present embodiment, the learning area is sorted into a first learning area as shown at section (c) in FIG. 1 and a second learning area as shown at section (d) in FIG. 1. The first learning area shown at (c) is divided at division points 8, 16, 23—which are representative of values of the intake air amount Qa and the second learning area shown at (d) is divided at division points 12, 20, 27—which are also representative of values of the intake air amount Qa, so that the division points of the first and second learning areas are offset with respect to each other. This ensures that even a running occurring near the boundary between adjacent divisional areas of the first learning area can be learnt at a divisional area of the second learning area. Learning values corresponding to the divisional areas of the first and second learning areas are stored in a RAM (rewritable memory) at its areas designated by $L_{1n}$ and $L_{2n}$. The characters $L_{1n}$ and $L_{2n}$ also represent learning values stored in the RAM areas $L_{1n}$ and $L_{2n}$, respectively.

The learning values $L_{1n}$ and $L_{2n}$ are renewed using the learning value correction amount Xn, and when a particular divisional area is to be renewed, concurrently therewith, two divisional areas immediately preceding and succeeding the particular divisional area are also renewed. For example, assuming that a divisional area $L_{2l}$ is renewed using a learning correction value Xn, adjacent two divisional areas $L_{20}$ and $L_{22}$ are also renewed concurrently by using correction amounts as indicated below the table shown at (d) in FIG. 1. Thus, the renewal is indicated as follows:

Renewal of $L_{21}$:

$$L_{21}New = L_{21}Old + Xn$$

Renewal of learning values of adjacent divisional areas:

$$L_{20}New = ko \times (L_{21}New + L_{20}Old)$$

$$L_{22}New = ko \times (L_{21}New + L_{22}Old)$$

where ko represents a renewal coefficient which is, for example, 0.5.

The overall operation explained in connection with FIGS. 1 and 2 can be implemented in accordance with flow charts as shown in FIGS. 3A–3E under the direction of a program of the microcomputer included in the control unit 1. This program is started at intervals of a predetermined period of, for example, 10 mS.

Firstly, it is decided in step Sl whether the $O_2$ sensor is made active (the active $O_2$ sensor can produce the output voltage which is changeable between 0 (zero) volt and 1.0 volt.). When the $O_2$ sensor is decided not to be active, the air/fuel ratio correction coefficient AL is set to 1.0 and the procedure ends (Step S2). When the $O_2$ sensor is decided to be active, it is decided in steps S3 to S8 whether the engine cooling water temperature TW is above 80° C., whether the enhancing correction term KW due to water temperature equals zero, whether the enhancing correction term KACC due to acceleration equals zero, whether the enhancing correction term KD after idling equals zero, whether lapse of time after acceleration exceeds a predetermined value and whether lapse of time after deceleration exceeds a predetermined value When either of the above decisions is negative, an OK flag for the first learning area and an OK flag for the second learning area are both cleared (Steps S9 and Sl0).

In contrast, when all of the requirements raised in the steps S3 to S8 are satisfied, the first learning area and the second learning area are retrieved for their divisional areas in accordance with a current intake air amount Qa (Step Sll), and it is decided whether a retrieved area coincides with a divisional area of the first learning area (Step Sl2) or whether a retrieved area coincides with a divisional area of the second learning area (Step Sl3). When coincidence is obtained in connection with the first learning area, the OK flag for the first learning area is set to binary "1" (Step Sl4) and the OK flag for the second learning area is then cleared (Step Sl5). With coincidence being otherwise obtained in connection with the second learning area, the OK flag for the second learning area is set to "1" (Step Sl6) and the OK flag for the first learning area is then cleared (Step S17).

Subsequently, it is decided in steps S18 to S20 whether feedback control conditions for the air/fuel ratio detected by the $O_2$ sensor are satisfied, that is, whether the water temperature TW is above 40° C., whether the throttle opening THV is below α° and whether the engine rotation number N is below a predetermined value No. When either of the above conditions is not satisfied, the air/fuel ratio correction coefficient AL is set to 1.0 and the procedure ends (Step S2).

Figure 3A:
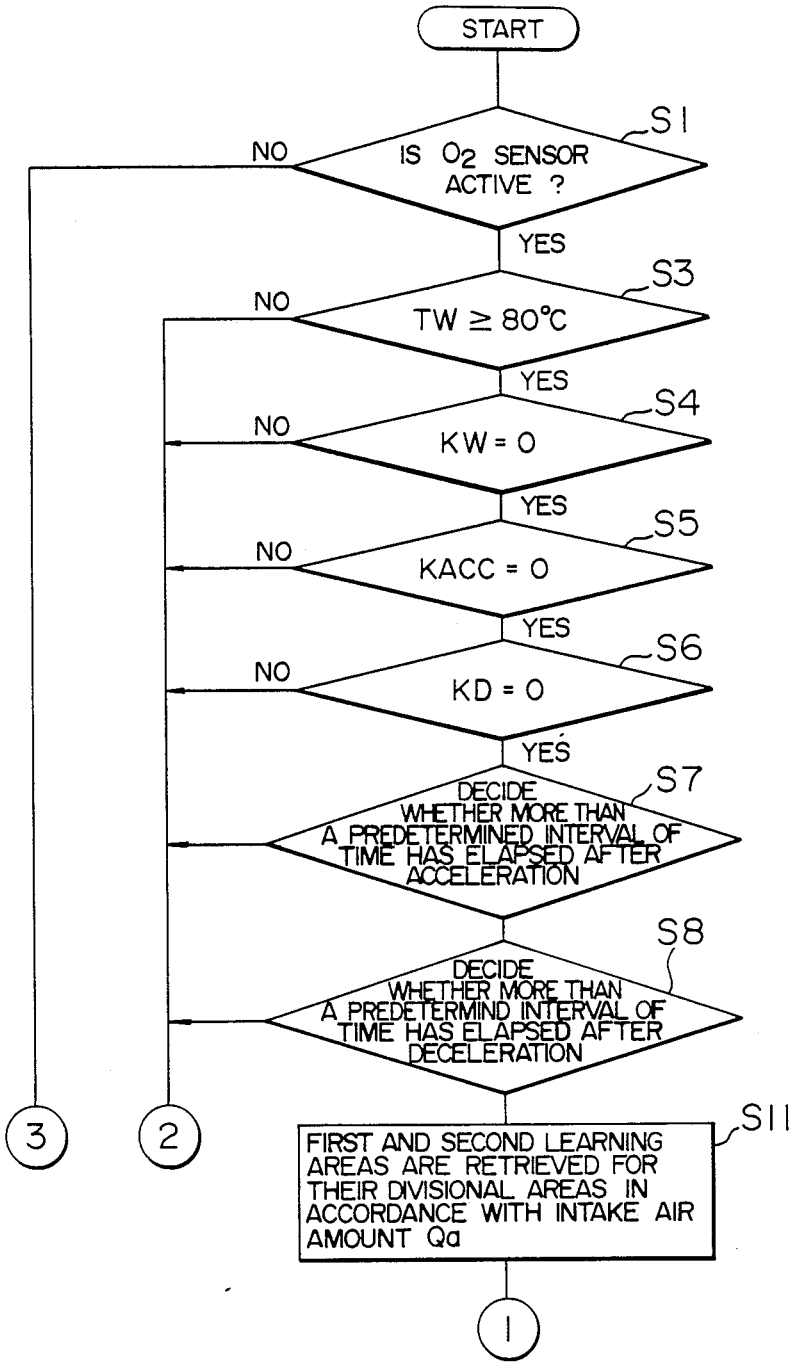
FIGS. 3A–3E are flow charts for explaining the operation of the embodiment of the invention.
Figure 3B:
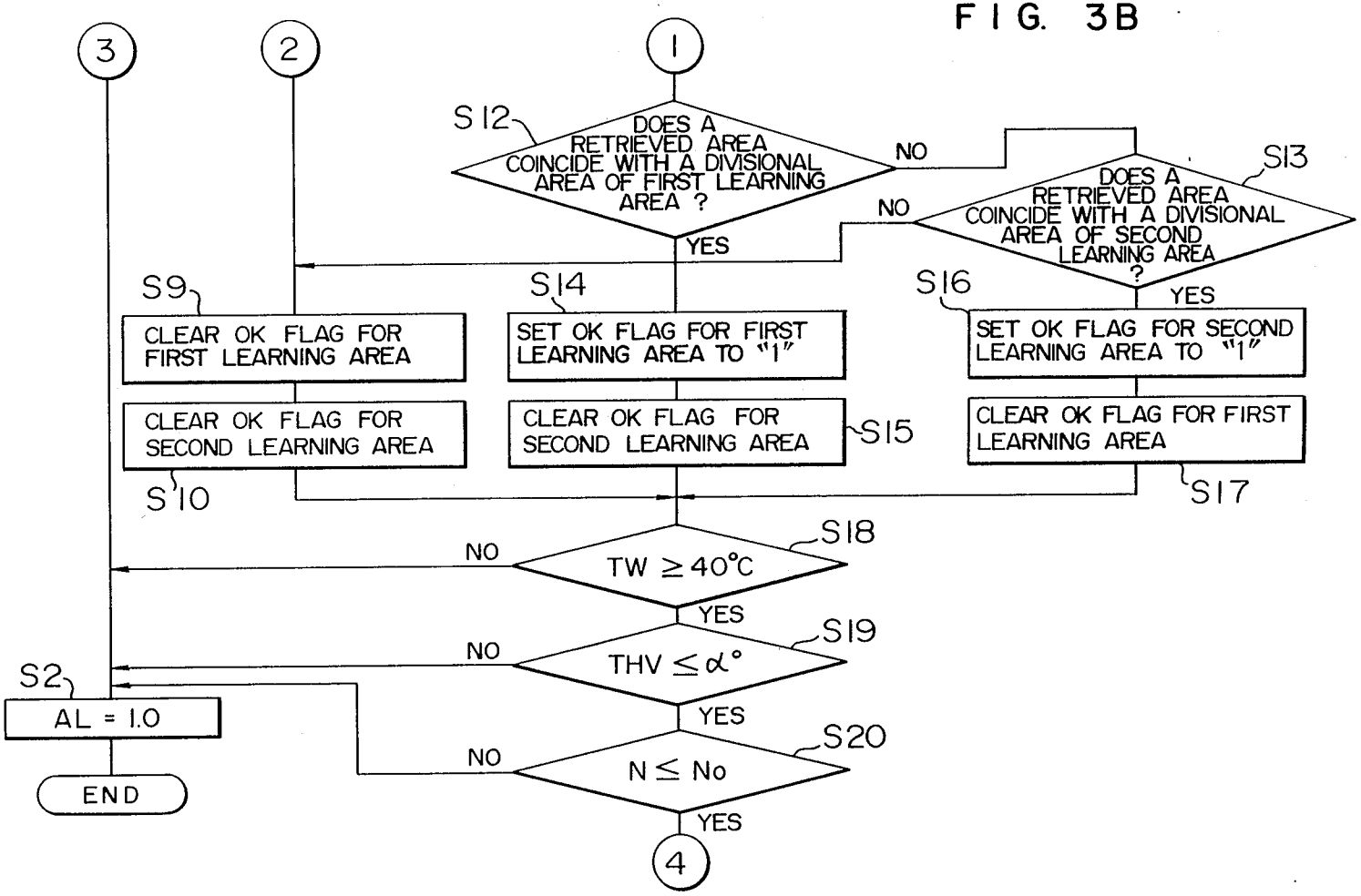
Figure 3C:
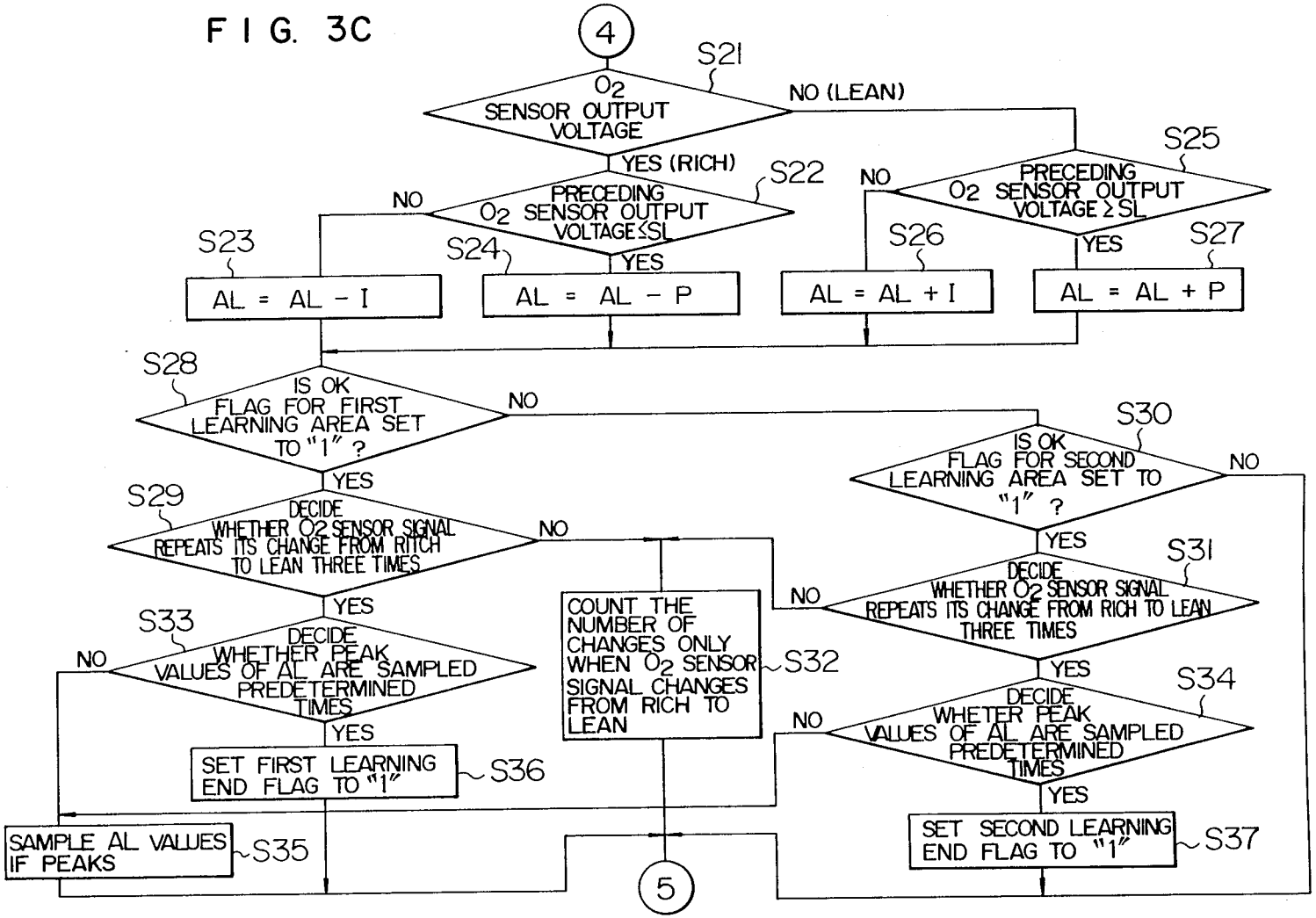
Figure 3D:
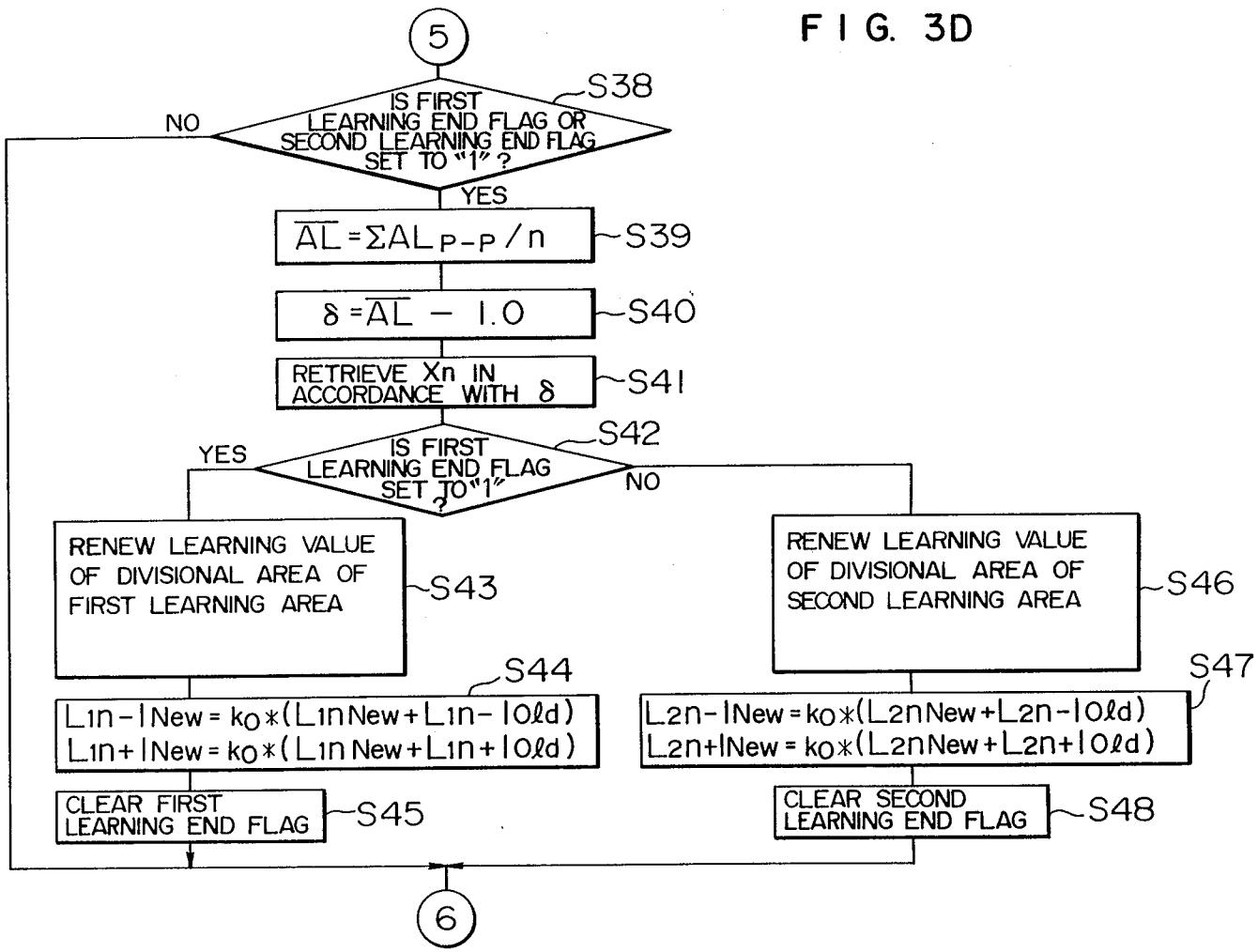
Figure 3E:
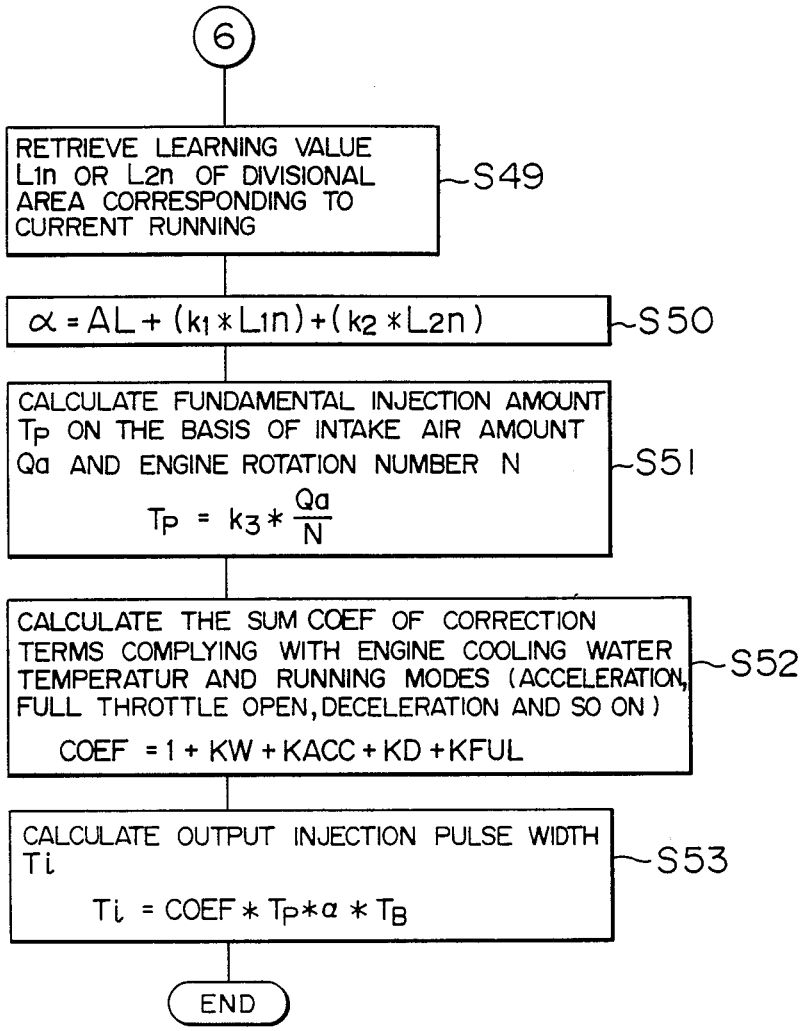

In contrast, when all of the conditions are satisfied, the procedure proceeds to the flow chart of FIG. 3C. In steps S2l to S27, the air/fuel ratio correction coefficient AL is added or subtracted with the proportional portion P and integration portion I in accordance with a current output voltage of the $O_2$ sensor. Thereafter, the OK flag for the first learning area or the OK flag for the second learning area is examined (Step S28 or S30). When the OK flag for the first learning area is "1", it is decided whether the $O_2$ sensor signal repeats its change from rich to lean three times in connection with the divisional area of the first learning area (Steps S29 and S32). Otherwise, when the OK flag for the second learning area is "1", it is decided whether the $O_2$ sensor signal repeats its change from rich to lean three times in connection with the divisional area of the second learning area (Steps S3l and S32). When the repetition of three changes is valid in connection with one of the first and second learning areas, peak values of the air/fuel ratio correction coefficient AL are sampled by predetermined times in order to calculate a mean value $\overline{AL}$ of the air/furl ratio correction coefficient (Steps S33 to S35), and one of first learning and flag and second learning end flag is set to "1" (Step S36 or S37). When one of the first learning end flag and second learning end flag is decided to be "1" (Step S38), the mean value $\overline{AL}$ of the air/fuel ratio correction coefficient is calculated, the difference δ is calculated, the learning correction amount Xn is retrieved, the learning value is renewed and the corresponding learning end flag is cleared (Steps S38 to S48) and then the procedure proceeds to the processing for calculating the injection pulse width Ti as shown in FIG. 3E.

Firstly, in step S49, the learning value $L_{1n}$ or $L_{2n}$ for the current divisional area of the first or second learning area in compliance with the intake air amount Qa is retrieved and then, in step S50, an ultimate air/fuel ratio correction coefficient α is calculated, where the weighting coefficients $k_1$ and $k_2$ have a value of, for example, 0.5. As an alternative, the ultimate air/fuel ratio correction coefficient α may be defined by constantly employing larger one of the two renewed learning values as follows:

$$\alpha = AL + L_{1n} \text{ for } L_{1n} \geqq L_{2n}$$

$$\alpha = AL + L_{2n} \text{ for } L_{1n} < L_{2n}$$

Subsequently, the fundamental injection amount $T_p$ is calculated on the basis of the intake air amount Qa and engine rotation number N (Step S5l) and finally, an ultimate injection pulse width Ti is calculated on the basis of the various correction coefficients and the correction term (Steps S52 and S53), ending the procedure.

Accordingly, in the embodiment described so far, the learning value can be renewed using the amount which is weighted in accordance with the difference between the air/fuel ratio correction coefficient and the reference value and in addition, a learning value of a particular divisional area can constantly be renewed concurrently with renewal of learning values of divisional areas adjacent to the particular divisional area in order to obtain proper and smooth controlling and the boundary in one learning area merges into the divisional area of the other learning area in order to increase the chance of learning and consequently to obtain learning of improved follow-up performance.

More specifically, in contrast to the prior art wherein the learning condition is across adjacent divisional areas when the running, even though being the steady running, occurs near the boundary on the point which divides the learning area with the result that learning is retarded and the chance of learning is lessened correspondingly, the foregoing embodiment features offset setting of division points for the two learning areas so that even when the running occurs near the division point for one learning area, the learning condition does not cross the division point for the other learning area, thereby increasing the chance of learning and improving the learning performance. While the foregoing embodiment has been described as applied to the air/fuel ratio controlling, the invention may also be applied to other controlling such as ignition timing controlling.

As described above, according to the invention, a learning value of a particular divisional area, together with learning values of divisional areas adjacent to the particular divisional area, can be renewed at a time by using the amount which is weighted in accordance with the difference between the air/fuel ratio correction coefficient and the reference value, thereby ensuring that excellent learning controlling can constantly be obtained on the basis of optimized learning results.

We claim:

1. A control apparatus for internal combustion engine comprising:

fundamental control amount deciding means for determining a fundamental control amount on the basis of operation parameters of an internal combustion engine;

feedback control means for correcting said fundamental control amount by feeding back a specified operation parameter of said internal combustion engine;

correction amount storage means having a plurality of divisional running areas obtained by dividing the running condition in accordance with values of said operation parameters of said internal combustion engine and storing values of a correction amount for correcting said fundamental control amount in respective divisional running areas; and correction amount renewing means for renewing the correction amount stored in said correction amount storage means in accordance with an output signal of said feedback control means in such a manner that when a value of the correction amount for a particular divisional running area is renewed, concurrently therewith, values of the correction amount for divisional running areas adjacent to the particular divisional running area are also renewed;

wherein when the correction amount for said particular divisional running area is renewed, the correction amount for each of said adjacent divisional running areas is concurrently renewed to a value equal to a product of a weighting value and a sum of a renewed value of the correction amount for said particular divisional running area for each adjacent division running area.

2. A control apparatus for internal combustion engine comprising:

fundamental control amount deciding means for determining a fundamental control amount on the basis of operation parameters of an internal combustion engine;

feedback control means for correcting said fundamental control amount by feeding back a specified operation parameter of said internal combustion engine;

correction amount storage means having a plurality of divisional running areas obtained by dividing the running condition in accordance with values of said operation parameters of said internal combustion engine and storing values of a correction amount for correcting said fundamental control amount in respective divisional running areas; and correction amount renewing means for renewing the correction amount stored in said correction amount storage means in accordance with an output signal of said feedback control means in such a manner that when as value of the correction amount for a particular divisional running area is renewed, concurrently therewith, values of the correction amount for divisional running areas adjacent to the particular divisional running area are also renewed;

wherein said correction amount storage means comprises a first and second storage areas respectively having divisional storage areas corresponding to the divisional running areas, a set of divisional storage areas of said first storage area and the other set of divisional storage areas of said second storage area being offset from each other to resemble offset of division points for the corresponding sets of divisional running areas, and said fundamental control amount is corrected in accordance with a value of the correction amount obtained either from a divisional storage area of said first storage area which is identical to a divisional running area representative of the current running or from a divisional storage area of said second storage area which is identical to a divisional running area representative of the current running.

3. A control apparatus for internal combustion engine according to claim 2, wherein values of the correction amount obtained from the divisional storage areas of said first and second storage areas are weighted by different coefficients, respectively, and are added together.

4. A control apparatus for internal combustion engine according to claim 1 wherein said fundamental control amount determined by said fundamental control amount deciding means is a fuel injection amount, said operation parameters are an intake air amount and an engine rotation number, and said specified operation parameter which is feedback-controlled by said feedback control mean is an air/fuel ratio.

* * * * *